US007000704B2

(12) United States Patent
Smith

(10) Patent No.: US 7,000,704 B2
(45) Date of Patent: Feb. 21, 2006

(54) LATCH PROFILE INSTALLATION IN EXISTING CASING

(75) Inventor: Ray C. Smith, Beaumont (CA)

(73) Assignee: Halliburton Energy Services, Inc., Houston, TX (US)

( * ) Notice: Subject to any disclaimer, the term of this patent is extended or adjusted under 35 U.S.C. 154(b) by 41 days.

(21) Appl. No.: 10/705,444

(22) Filed: Nov. 10, 2003

(65) Prior Publication Data

US 2004/0104031 A1 Jun. 3, 2004

Related U.S. Application Data

(62) Division of application No. 10/147,567, filed on May 16, 2002, now Pat. No. 6,808,022.

(51) Int. Cl.
*E21B 23/02* (2006.01)

(52) U.S. Cl. ..... 166/382; 166/387; 166/117.7; 166/207

(58) Field of Classification Search ..... 166/381, 166/382, 384, 386, 387, 114, 117, 117.7, 166/118, 207, 208, 212, 217
See application file for complete search history.

(56) References Cited

U.S. PATENT DOCUMENTS

| | | | |
|---|---|---|---|
| 5,044,441 | A | 9/1991 | Rubbo et al. |
| 5,579,829 | A | 12/1996 | Comeau et al. |
| 5,620,052 | A | 4/1997 | Turner |
| 5,865,255 | A | 2/1999 | Hammett et al. |
| 6,003,607 | A | 12/1999 | Hagen et al. |
| 6,053,248 | A | 4/2000 | Ross |
| 6,125,937 | A | 10/2000 | Longbottom et al. |
| 6,135,208 | A | 10/2000 | Gano et al. |

FOREIGN PATENT DOCUMENTS

| | | | |
|---|---|---|---|
| GB | 2345308 | A | 7/2000 |
| GB | 2368862 | A | 5/2002 |
| WO | WO 00/61908 | A1 | 10/2000 |

OTHER PUBLICATIONS

Sperry-Sun Multilateral Services Profile, "Sperry-Sun Latch Coupling", dated 2000.

*Primary Examiner*—Frank S. Tsay
(74) *Attorney, Agent, or Firm*—Marlin R. Smith

(57) ABSTRACT

A method of installing an internal latch profile in an existing tubular string does not require the use of a packer. In a described embodiment, a method of latch installation includes the step of deforming an interior surface of the tubular string after the tubular string is positioned in a well. In another described embodiment, a method of latch installation includes the step of cutting into the interior surface of the tubular string.

21 Claims, 3 Drawing Sheets

LATCH PROFILE INSTALLATION IN EXISTING CASING

CROSS-REFERENCE TO RELATED APPLICATION

The present application is a division of prior application Ser. No. 10/147,567, filed May 16, 2002 now U.S. Pat. No. 6,808,022. The entire disclosure of this prior application is incorporated herein by this reference.

BACKGROUND

The present invention relates generally to operations performed in conjunction with a subterranean well and, in an embodiment described herein, more particularly provides a method whereby a latch profile is installed in a tubular string.

It is common practice to set a packer (or another anchoring device, such as a liner hanger or hanger/packer) in a casing string in a parent wellbore prior to drilling a branch wellbore. The packer provides a secure platform to which a whipstock may be attached during the processes of milling through the casing and drilling the branch wellbore. The packer also seals against the casing, which may be used to provide pressure isolation for a zone of the parent wellbore below the intersection with the branch wellbore, or which may aid in preventing debris from falling down in the parent wellbore.

Various types of packers have been used for this purpose—permanent packers, retrievable packers, hydraulically set packers, mechanically set packers, etc. Nevertheless, all of these various types of packers share a common disadvantage in that they restrict access and flow through the parent wellbore. If full bore access to the parent wellbore below the branch wellbore intersection is desired after the branch wellbore is drilled, the packer must be unset and retrieved from the well (which is many times quite difficult to accomplish), or the packer must be milled through or washed over (which is quite time-consuming).

Because of this wellbore restriction due to the use of packers in multilateral wellbore drilling, multilateral wells are typically constructed from bottom up. That is, a first branch wellbore is drilled from a parent wellbore, then a second branch wellbore is drilled from the parent wellbore at a location above the intersection between the parent and first branch wellbores, then a third branch wellbore is drilled from the parent wellbore at a location above the intersection between the parent and second branch wellbores, etc. This situation unnecessarily limits the options available to the operator, such as to drill the branch wellbores in another, more advantageous, sequence or to drill a previously unplanned branch wellbore below another branch wellbore, etc.

In addition, a packer relies on a gripping engagement with the casing using slips. This gripping engagement may fail due to the severe forces generated in the milling and drilling operations. Such gripping engagement also provides limited radial orientation of the packer relative to the casing, so if the gripping engagement is ever relieved (such as, by unsetting the packer), any subsequent radial orientation relative to the casing (for example, to re-enter the branch wellbore) will not be able to benefit from the original orientation of the packer.

SUMMARY

In carrying out the principles of the present invention, in accordance with an embodiment thereof, a method is provided in which a latch profile is installed in a tubular string after the tubular string is positioned in a well. The method permits an apparatus such as a whipstock to be secured in the tubular string. The latch profile may provide for radial orientation of the apparatus.

In one aspect of the invention, the latch profile is formed on an expandable latch structure which is conveyed into the tubular string. The latch structure is then expanded outward, thereby securing the latch profile to the tubular string. For example, the latch structure may deform the tubular string when it is expanded outward, thereby recessing the latch structure into an interior surface of the tubular string and leaving full bore access through the tubular string. Bonding agents, such as adhesives and sealants may be used to bond the latch structure to the tubular string.

In another aspect of the invention, the latch profile may be formed on the interior surface of the tubular string by creating recesses on the interior surface. The recesses may be formed in a predetermined pattern, so that an apparatus engaged therewith will be secured relative to the tubular string and radially oriented relative to the tubular string.

In yet another aspect of the invention, the latch profile may be formed on the interior surface of the tubular string by cutting into the interior surface to create the recesses. For example, cutting tools such as drills or mills may be used. If the recesses extend through a sidewall of the tubular string, thereby forming openings through the sidewall, sealant may be injected into the openings to prevent fluid flow therethrough.

In still another aspect of the invention, the latch profile may be installed in the tubular string using any of the methods summarized above, and then an apparatus may be operatively engaged with the profile in a single trip into the well. This may be accomplished by attaching the apparatus to a latch profile installation assembly and conveying these together into the well.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
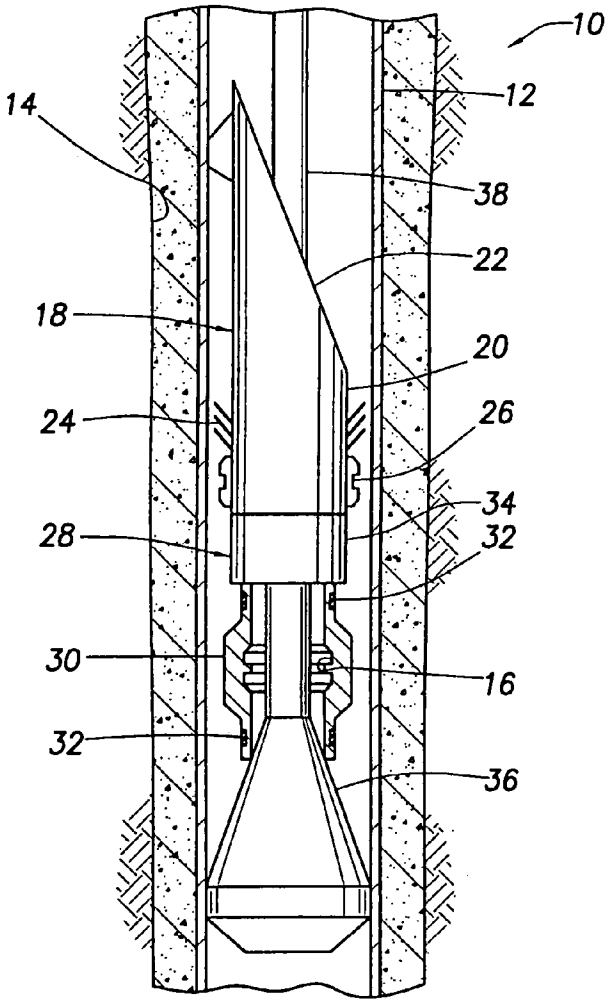
FIG. 1 is a schematic cross-sectional view of a first method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a casing string 12 has been positioned in a parent wellbore 14 and has been cemented therein. The casing string 12 could be any type of tubular string, such as a string of liner, etc., and the parent wellbore 14 could be any type of wellbore, such as a branch wellbore, a vertical, horizontal or deviated wellbore, etc., in keeping with the principles of the invention. In addition, the terms "cemented", "cement", "cementing", etc. as used herein are intended to encompass any means of securing and sealing the casing string 12 in the wellbore 14. For example, materials such as epoxies, gels, resins, polymers, elastomers, etc., as well as cementitious materials, may be used for this purpose.

After the casing string 12 has been cemented in the wellbore 14, a latch profile 16 is installed in the casing. Representatively, the latch profile 16 is used in the method 10 to position a whipstock assembly 18 at a location in the casing string 12 where it is desired to drill a branch wellbore. However, it is to be clearly understood that the latch profile 16 may be used for any of a large variety of purposes other than positioning the whipstock assembly 18, without departing from the principles of the invention. For example, the latch profile 16 could be used to position a device for re-entering the branch wellbore after it is drilled and the whipstock assembly 18 is retrieved from the well, the latch profile could be used to position a flow control device, such as a plug or valve, to control fluid flow in the parent and/or branch wellbores, etc.

The whipstock assembly 18 includes a whipstock 20 having an upper deflection surface 22, a wiper or seal 24 and one or more keys, lugs or dogs 26 for engagement with the latch profile 16. The deflection surface 22 is used to deflect cutting tools, such as mills and drill bits, to drill the branch wellbore outward from the parent wellbore 14. The seal 24 is used to prevent debris from fouling the latch profile 16 or from falling down into the parent wellbore 14 therebelow. The keys 26 are complementarily shaped relative to the profile 16 and may be continuously radially outwardly biased, or they may be selectively actuated to extend outward into engagement with the profile when desired.

As used herein, the term "whipstock" is used to designate any type of deflection device which may be used in a well to deflect an object from one wellbore to another.

Attached to a lower end of the whipstock assembly 18 is a running tool 28. The running tool 28 is used to install the latch profile 16 in the casing 12. Specifically, the running tool 28 is used to outwardly expand a latch structure 30 on which the latch profile 16 is internally formed.

The latch structure 30 may be a circumferentially continuous generally tubular shaped structure with the latch profile 16 formed on an interior surface thereof. However, it is to be understood that the latch structure 30 could be otherwise shaped and configured. For example, the latch structure 30 could be made up of multiple segments each of which is displaced outward to expand the latch structure. If the latch structure 30 is circumferentially continuous, it may be expanded outward by circumferential stretching.

Carried externally on the latch structure 30 is a bonding agent 32. The bonding agent 32 may be an adhesive for securing the latch structure 30 to the casing 12, or the bonding agent may be a sealant for forming a seal between the latch structure and the casing. Of course, the bonding agent 32 could be an adhesive sealant, and separate adhesive and sealant could also be used. In addition, other means of securing the latch structure 30 to the casing 12 (for example, thermal welding, piercing of the casing, deploying a spear-type device to connect and secure the latch structure to the casing, etc.), and other means of sealing between the latch structure and the casing, may be used without departing from the principles of the invention.

However, it should be understood that the bonding agent 32 is not necessary in the method 10, since the latch structure 30 could be secured and/or sealed to the casing 12 by contact therebetween. For example, a metal to metal seal may be formed between the latch structure 30 and the casing 12 when the latch structure is expanded outward into contact with the casing.

The latch profile 16 is preferably of the type known to those skilled in the art as an orienting profile. That is, once installed in the casing string 12, the latch profile 16 will serve to radially orient an apparatus engaged therewith relative to the casing string. For example, the whipstock assembly 18 will be radially oriented so that cutting tools are deflected off of the deflection surface 22 in a desired direction to drill the branch wellbore when the whipstock assembly is operatively engaged with the latch profile 16. Of course, other types of profiles may be used for the latch profile 16 in keeping with the principles of the invention.

The running tool 28 includes an actuator 34 and a conically-shaped wedge 36. The actuator 34 is used to displace the wedge 36 through the latch structure 30 to thereby outwardly expand the latch structure. The actuator 34 may be any type of actuator, such as a hydraulic, mechanical, explosive or electrical actuator.

As depicted in FIG. 1, the whipstock assembly 18 and running tool 28 are conveyed into the casing string 12 on a tubing string 38. Any form of conveyance may be used in place of the tubing string 38. For example, a wireline or slickline could be used. Furthermore, note that the tubing string 38 may be a segmented or a continuous tubing string, such as a coiled tubing string.

Figure 2:
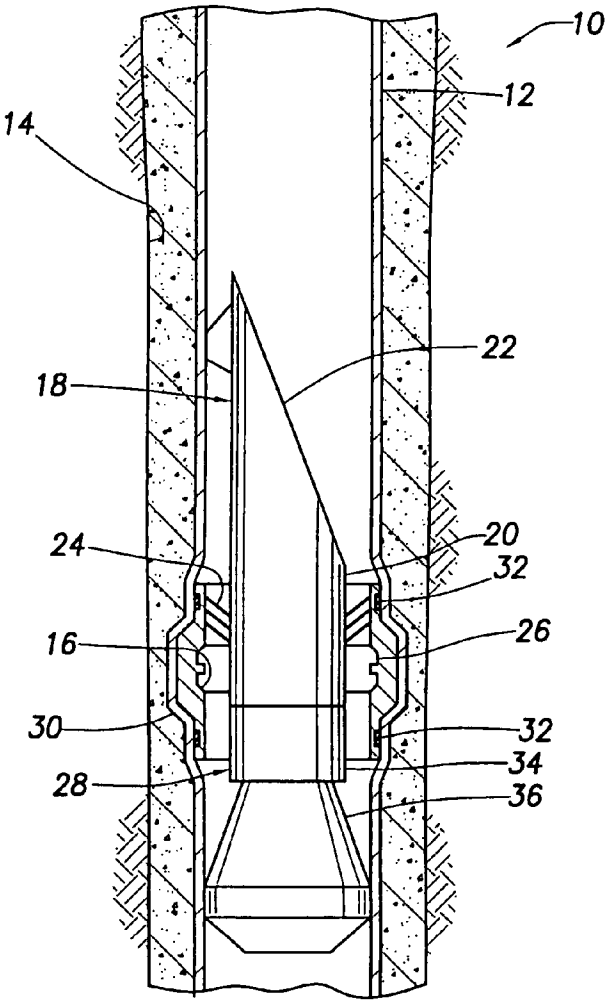
FIG. 2 is a schematic cross-sectional view of the first method of FIG. 1, wherein further steps of the method have been performed.

Referring additionally now to FIG. 2, the method 10 is representatively illustrated after the latch structure 30 has been expanded outward. Upward displacement of the wedge 36 by the actuator 34 has outwardly expanded the latch structure 30 so that the casing string 12 is plastically deformed, outwardly deforming a sidewall of the casing. The latch profile 16 is thereby secured to the casing string 12.

Note that a minimum inner diameter of the latch structure 30 is substantially equal to the minimum inner diameter of the casing string 12. Thus, the latch structure 30 permits full bore access through the casing string 12. However, the latch structure 30 could have an inner diameter smaller than the inner diameter of the casing string 12, without departing from the principles of the invention.

The bonding agent 32 adheres the latch structure 30 to the casing string 12 and/or forms a seal between the latch structure and the casing string. If the latch structure 30 is made up of individual segments, the bonding agent 32 may prevent the segments from falling inwardly.

The whipstock assembly 18 has been lowered in the casing string 12, So that the keys 26 operatively engage the latch profile 16. This engagement secures the whipstock 20 and radially orients the whipstock relative to the casing string 12.

The seal 24 is received in an upper bore of the latch structure 30. This engagement between the seal 24 and the latch structure 30 may serve to prevent fouling of the latch profile 16 and/or prevent debris from falling into the parent wellbore 14 below the whipstock assembly 18.

Note that the latch profile 16 has been installed and the whipstock assembly 18 has been engaged with the latch profile in only a single trip into the casing string 12. This enhances the economical performance of the method 10. However, it should be understood that the latch profile 16 could be installed and an apparatus engaged therewith in multiple trips into the casing string 12, without departing from the principles of the invention.

Figure 3:
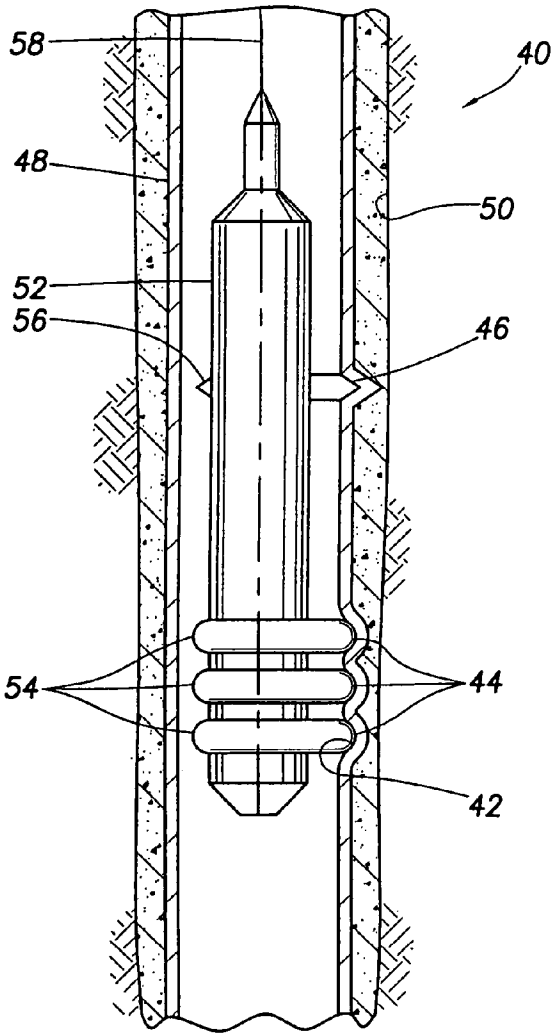
FIG. 3 is a schematic cross-sectional view of a second method embodying principles of the present invention.

Referring additionally now to FIG. 3, another method 40 embodying principles of the present invention is representatively illustrated. In the method 40, a latch profile 42 made up of multiple spaced apart recesses 44, 46 is installed in a casing string 48 after the casing string is positioned in a wellbore 50. Specifically, the recesses 44, 46 are formed in the casing string 48 by plastically deforming the casing string using a forming apparatus 52.

The forming apparatus 52 includes dies 54, 56 which are outwardly extendable to engage an interior surface of the casing string 48. On the left hand side of FIG. 3, the dies 54, 56 are depicted in retracted positions thereof. On the right hand side of FIG. 3, the dies 54, 56 are depicted in extended positions thereof, forming the recesses 44, 46 on the interior surface of the casing string 48 by plastically deforming a sidewall of the casing string.

The dies 54 are circumferentially continuous (i.e., ring-shaped), so that the recesses 44 are also circumferentially continuous. The die 56 is not circumferentially continuous, but produces the discreet recess 46 at a particular desired radial orientation on the casing string 12. The recesses 44 are used to secure an apparatus (such as the whipstock assembly 18 described above) against axial displacement through the casing string 48, and the recess 46 is used to radially orient the apparatus relative to the casing string.

Thus, the recesses 44, 46 are arranged in a predetermined pattern, so that an apparatus subsequently engaged therewith will be secured and radially oriented relative to the casing string 48. For example, the whipstock assembly 18 described above could have keys, dogs or lugs carried thereon in a complementarily shaped pattern to operatively engage the recesses 44, 46. Preferably, the recess 46 would be engaged when the whipstock assembly 18 is properly radially oriented relative to the casing string 48.

As depicted in FIG. 3, the forming tool 52 is conveyed into the casing string 48 on a wireline 58, but any other type of conveyance could be used. The forming tool 52 may be hydraulically, mechanically, explosively or electrically actuated to extend the dies 54, 56 outward. However, it should be understood that the forming tool 52 may be actuated in any manner, and may be configured in any manner to produce any desired pattern of recesses, in keeping with the principles of the invention.

Figure 4:
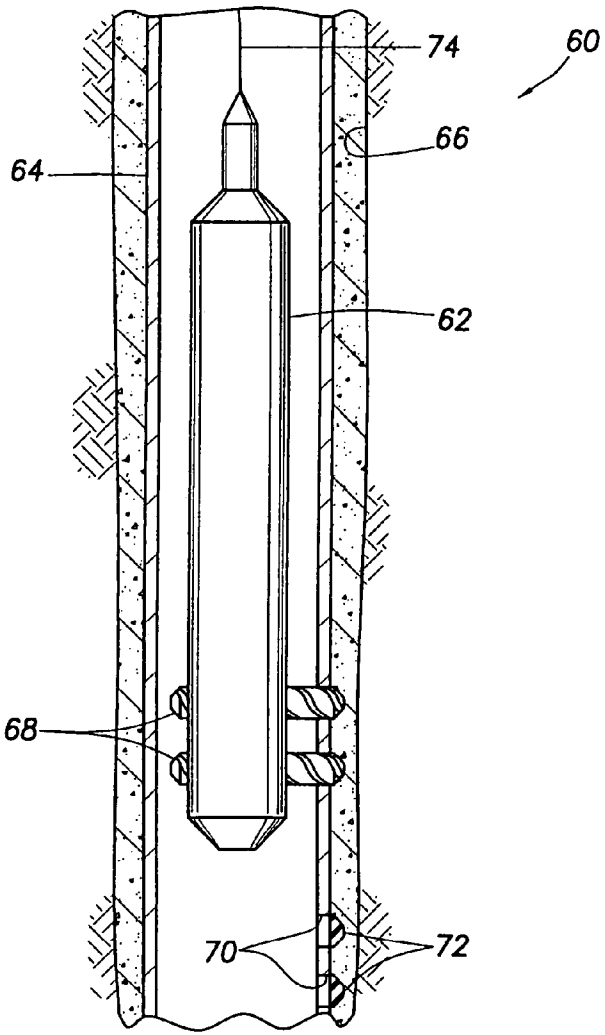
FIG. 4 is a schematic cross-sectional view of a third method embodying principles of the present invention.

Referring additionally now to FIG. 4, another method 60 embodying principles of the present invention is representatively illustrated. In the method 60, a cutting apparatus 62 is used to cut into an interior surface of a casing string 64 positioned in a wellbore 66. Specifically, cutting tools 68 are outwardly extended from the apparatus 62 to form recesses 70 in the interior surface of the casing string 64.

On the left hand side of FIG. 4 the cutting tools 68 are depicted in retracted positions thereof, and on the right hand side of FIG. 4 the cutting tools are depicted in extended positions thereof. There may be only one of the cutting tools 68, which may be used multiple times to cut corresponding multiple recesses 70, or there may be the same number of cutting tools as recesses to be cut, etc.

The cutting tools 68 may be drill bits, mills, keyway cutters, or any other type of cutting tool. Alternatively, the cutting tools 68 could be nozzles for a high pressure water jet. In that case, it would not be necessary to outwardly extend the cutting tools 68 from the apparatus 62 in order to cut into the casing 64. Water jet cutting of the casing 64 may be preferred for cutting a detailed profile into the casing 64.

As depicted in FIG. 4, the recesses 70 are preferably cut in a predetermined pattern, so that an apparatus (such as the whipstock assembly 18 described above) subsequently engaged therewith will be secured and radially oriented relative to the casing string 64. That is, the whipstock assembly 18 or other apparatus may be provided with keys, lugs or dogs arranged in a complementarily shaped pattern to operatively engage the recesses 70. The pattern of recesses 70 thus make up the latch profile installed by the cutting apparatus 62. Preferably, the recesses 70 are operatively engaged when the whipstock assembly 18 or other apparatus is radially oriented in a desired direction relative to the casing string 64.

The recesses 70 may extend through a sidewall of the casing string 64, so that they form openings through the casing sidewall. In that case, it may be desired to prevent fluid flow through the openings. A sealant 72 may be injected through the openings 70 for this purpose. For example, the sealant 72 may be an epoxy, polymer, resin, cement, or any other type of sealant.

As depicted in FIG. 4, the cutting apparatus 62 is conveyed into the casing string 64 by a wireline 74. However, it is to be understood that any type of conveyance may be used in place of the wireline 74. For example, a tubing string could be used to convey the apparatus 62.

As with the running tool 28 described above, the forming tool 52 and/or the cutting apparatus 62 may be conveyed into a well attached to an apparatus which is to be operatively engaged with the latch profile installed by the forming tool or cutting apparatus. For example, the whipstock assembly 18 could be attached to the forming tool 52 when it is conveyed into the casing string 48, or the whipstock assembly could be attached to the cutting apparatus 62 when it is conveyed into the casing string 64. Thus, the latch profiles installed by the forming tool 52 and the cutting apparatus 62 may be operatively engaged by an apparatus, such as the whipstock assembly 18, in a single trip into the well.

Figure 5A:
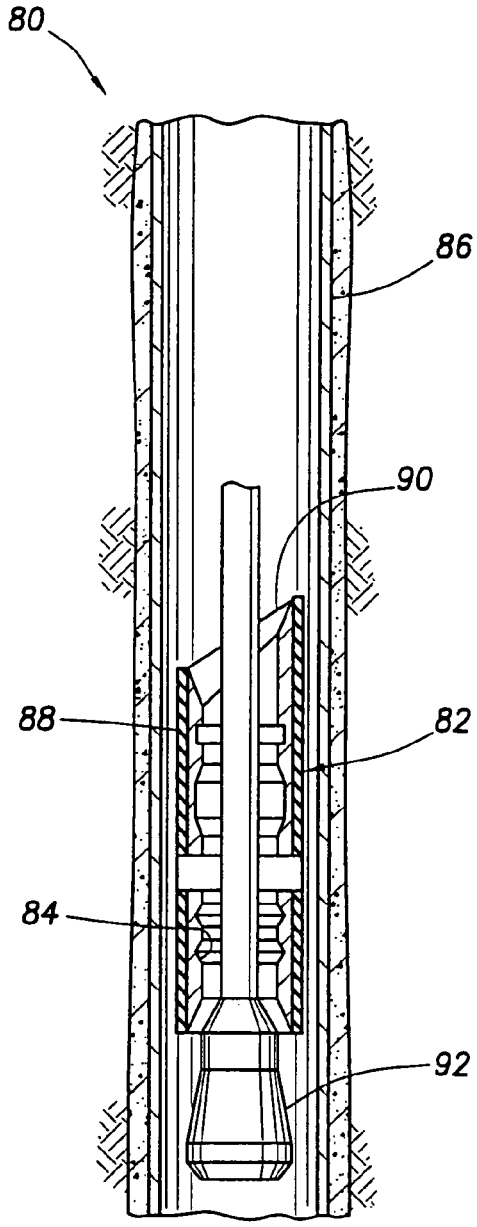
FIGS. 5A & B are schematic cross-sectional views of a fourth method embodying principles of the invention.

Referring additionally now to FIGS. 5A & B, another method 80 embodying principles of the invention is representatively illustrated. In the method 80, an expandable latch structure 82 having a latch profile 84 formed internally thereon is conveyed into a casing string 86, in a manner similar to that described above for the method 10. The latch structure 82 is preferably generally tubular and circumferentially continuous, but could be circumferentially segmented if desired.

The latch structure 82 has a layer of a bonding agent 88 on the external surface of the latch structure. The bonding agent 88 may be similar to the bonding agent 32 in the method 10. The bonding agent 88 is used to adhere and/or seal the latch structure 82 to the casing string 86. Suitable materials for the bonding agent 88 may be elastomers, epoxies, other polymer compositions, resins, cements, other sealants, other adhesives, etc.

However, it should be understood that the bonding agent 88 is not necessary in the method 80, since the latch structure 82 could be secured and/or sealed to the casing string 86 by contact therebetween. For example, a metal to metal seal may be formed between the latch structure 82 and the casing string 86 when the latch structure is expanded outward into contact with the casing string.

The profile 84 may be an orienting profile, that is, equipment (such as the whipstock 20 described above) operatively engaged with the profile is rotationally oriented relative to the casing string 86, as well as being secured axially and rotationally thereto. Alternatively, or in addition, the latch structure 82 may include a laterally inclined upper surface go (known to those skilled in the art as a "mule-shoe") for rotationally orienting and securing the equipment. Preferably, the latch structure 82 is rotationally oriented relative to the casing string 86 prior to expanding the latch structure in the casing string.

Figure 5B:
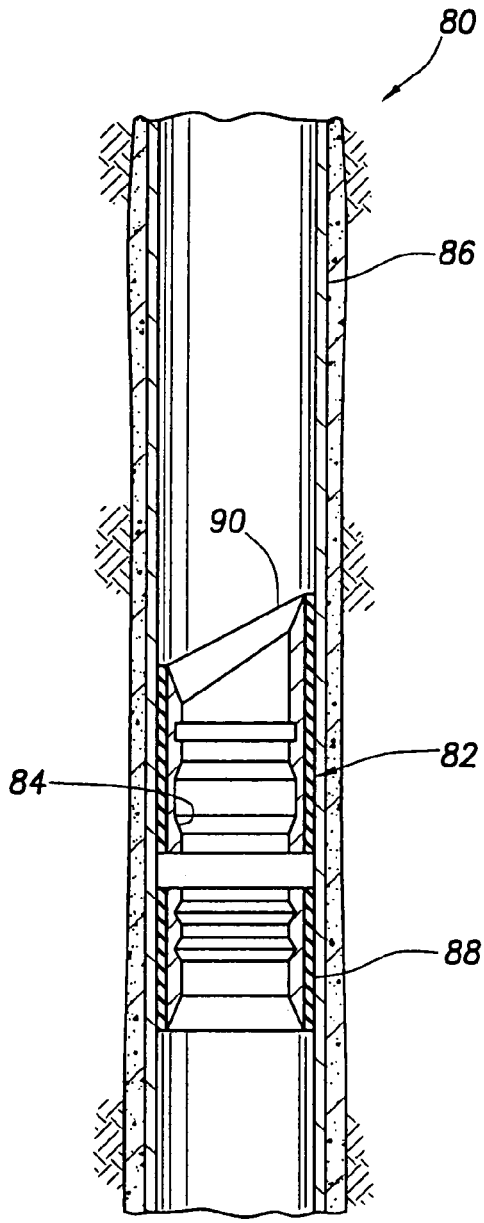

The latch structure 82 is depicted in FIG. 5A in its radially compressed, or unexpanded, configuration. The latch structure 82 is depicted in FIG. 5B in its radially expanded configuration, with the bonding agent 88 contacting and securing and/or sealing the latch structure to the casing string 86. A conical wedge 92 may be displaced through the latch structure 82 to expand the latch structure radially outward, or other means may be used for this purpose.

As depicted in FIG. 5B, the latch structure 82 in its expanded configuration has a minimum diameter therethrough which is somewhat less than the inner diameter of the casing string 86. However, the latch structure 82 may be further radially outwardly expanded to recess the latch structure into the inner wall of the casing string 86 (similar to the manner in which the latch structure 30 is recessed into the casing 12 in the method 10) in which case the latch structure 82 could have a minimum diameter substantially equal to, or at least as great as, the casing inner diameter.

Of course, a person skilled in the art would, upon a careful consideration of the above description of representative, embodiments of the invention, readily appreciate that many modifications, additions, substitutions, deletions, and other changes may be made to these specific embodiments, and such changes are contemplated by the principles of the present invention. For example, a latch profile may be installed in a casing string using a combination of various forming and cutting methods. Accordingly, the foregoing detailed description is to be clearly understood as being given by way of illustration and example only, the spirit and scope of the present invention being limited solely by the appended claims and their equivalents.

What is claimed is:

1. A method of installing a latch profile in a tubular string in a subterranean well, the method comprising the steps of:

positioning the tubular string in the subterranean well;

then conveying a latch structure into the tubular string;

orienting the latch structure rotationally relative to the tubular string, including rotationally orienting a mule-shoe of the latch structure relative to the tubular string; and then expanding the latch structure outward in the tubular string.

2. A method of installing a latch profile in a tubular string in a subterranean well, the method comprising the steps of:

positioning the tubular string in the subterranean well;

then conveying a latch structure into the tubular string;

orienting the latch structure rotationally relative to the tubular string, including rotationally orienting a laterally inclined surface of the latch structure relative to the tubular string; and then expanding the latch structure outward in the tubular string.

3. A method of installing a latch profile in a tubular string in a subterranean well, the method comprising the steps of:

positioning the tubular string in the subterranean well; and then forming the latch profile in the tubular string, the forming step including:

conveying the latch profile into the tubular string in an expandable structure, rotationally orienting the expandable structure relative to the tubular string, and outwardly expanding the expandable structure in the tubular string, the expanding step including deforming the tubular string, thereby recessing the expandable structure into the tubular string.

4. The method according to claim 3, wherein the deforming step further comprises plastically deforming the tubular string.

5. The method according to claim 3, further comprising the step of bonding the expandable structure to the tubular string.

6. The method according to claim 3, wherein the forming step further comprises forming the latch profile so that a minimum internal dimension of the profile is substantially equal to or greater than a minimum internal diameter of the tubular string.

7. The method according to claim 3, further comprising the step of cementing the tubular string in the well prior to the forming step.

8. The method according to claim 3, wherein the expanding step is performed after the rotationally orienting step.

9. The method according to claim 3, wherein the rotationally orienting step further comprises rotationally orienting a laterally inclined surface formed on the expandable structure relative to the tubular string.

10. A method of installing a latch profile in a tubular string in a subterranean well, the method comprising the steps of:

conveying the latch profile in an expandable structure into the tubular string;

rotationally orienting the expandable structure relative to the tubular string; and then plastically deforming the tubular string, thereby installing the latch profile in the tubular string.

11. The method according to claim 10, wherein the deforming step further comprises outwardly expanding the expandable structure.

12. The method according to claim 10, wherein the deforming step further comprises outwardly displacing a sidewall of the tubular string, thereby recessing the expandable structure into the sidewall.

13. The method according to claim 10, wherein the latch profile is an orienting profile, and further comprising the step of engaging an apparatus with the profile after the deforming step, thereby rotationally orienting the apparatus relative to the tubular string.

14. The method according to claim 10, further comprising the step of engaging an apparatus with the latch profile after the deforming step, thereby securing the apparatus relative to the tubular string, the deforming and engaging steps being performed in a single trip into the tubular string.

15. A method of installing a latch profile in a tubular string in a subterranean well, the method comprising the steps of:

positioning the tubular string in the subterranean well;

then conveying the latch profile in an expandable structure into the tubular string;

then rotationally orienting the expandable structure relative to the tubular string; and then expanding the latch structure outward in the tubular string.

16. The method according to claim 15, wherein the expanding step further comprises forming a seal between the expandable structure and the tubular string.

17. The method according to claim 15, wherein the expanding step further comprises bonding the expandable structure to the tubular string.

18. The method according to claim 15, wherein the expanding step further comprises deforming the tubular string.

19. The method according to claim 18, wherein the deforming step further comprises plastically deforming the tubular string.

20. The method according to claim 18, wherein the deforming step further comprises expanding the tubular string.

21. The method according to claim 15, wherein the expanding step further comprises expanding the expandable structure so that a minimum internal dimension of the expandable structure is substantially equal to or greater than a minimum internal diameter of the tubular string.

* * * * *